US007540695B2

(12) United States Patent
Snowdon

(10) Patent No.: US 7,540,695 B2
(45) Date of Patent: Jun. 2, 2009

(54) CONTAINER

(75) Inventor: Brian Snowdon, Doncaster (GB)

(73) Assignee: Inbulk Technologies Limited (GB)

( * ) Notice: Subject to any disclaimer, the term of this patent is extended or adjusted under 35 U.S.C. 154(b) by 0 days.

(21) Appl. No.: 10/592,558

(22) PCT Filed: Mar. 14, 2005

(86) PCT No.: PCT/GB2005/000961

§ 371 (c)(1),
(2), (4) Date: Nov. 21, 2006

(87) PCT Pub. No.: WO2005/087622

PCT Pub. Date: Sep. 22, 2005

(65) Prior Publication Data

US 2007/0187432 A1 Aug. 16, 2007

(30) Foreign Application Priority Data

Mar. 13, 2004 (GB) ..... 0405715.4

(51) Int. Cl.
*B65G 53/36* (2006.01)

(52) U.S. Cl. ..... 406/119; 406/120; 406/143

(58) Field of Classification Search ..... 406/119, 406/120, 141, 142, 143
See application file for complete search history.

(56) References Cited

U.S. PATENT DOCUMENTS 2,499,766 A * 3/1950 Macleod ..... 406/120
3,088,777 A * 5/1963 Aller ..... 406/119
3,105,721 A * 10/1963 Collins et al. ..... 406/39
3,180,689 A * 4/1965 Albert ..... 406/119
3,352,606 A * 11/1967 Page et al. ..... 406/138
3,858,763 A * 1/1975 Mack ..... 406/133
3,861,753 A * 1/1975 Lesk et al. ..... 406/30
3,993,359 A * 11/1976 Sweeney ..... 406/137
4,088,373 A * 5/1978 White ..... 406/141
4,502,819 A * 3/1985 Fujii et al. ..... 406/14
4,521,139 A * 6/1985 Kretschmer et al. ..... 406/19
4,662,799 A * 5/1987 Paul et al. ..... 406/14
4,701,185 A * 10/1987 Eckstein ..... 48/197 R
4,749,312 A * 6/1988 Raibaud ..... 406/30
4,787,783 A * 11/1988 Girardelli ..... 406/106
4,823,989 A * 4/1989 Nilsson ..... 222/630
4,830,546 A * 5/1989 Withiam et al. ..... 406/41
4,917,544 A * 4/1990 Crahan et al. ..... 406/14

(Continued)

FOREIGN PATENT DOCUMENTS

WO WO 01/00509 1/2001

(Continued)

OTHER PUBLICATIONS

Int'l Search Report and Written Opinion for PCT/GB2005/000961 dated Jun. 1, 2005, the priority PCT case of the present application.

*Primary Examiner*—Douglas A Hess
(74) *Attorney, Agent, or Firm*—Ryan A. Schneider, Esq.; Troutman Sanders LLP

(57) ABSTRACT

A container for the transport or storage of a bulk granular product is of generally cylindrical shape. Within the container is located a substantially conical exit hopper (13, 15, 17) and means (21) to convey the granular product from the exit hopper to the exterior of the container.

11 Claims, 3 Drawing Sheets

U.S. PATENT DOCUMENTS 4,971,482 A * 11/1990 Kjorling ..... 406/124
5,248,227 A * 9/1993 Hidock et al. ..... 406/41
5,353,967 A * 10/1994 Toth et al. ..... 222/181.3
5,379,706 A * 1/1995 Gage et al. ..... 111/175
5,618,136 A * 4/1997 Smoot ..... 406/93
5,775,852 A * 7/1998 Boutte et al. ..... 406/32
6,948,887 B1 * 9/2005 Yielding et al. ..... 406/119

FOREIGN PATENT DOCUMENTS

WO WO 2004/054899 4/2004

* cited by examiner

CONTAINER

This application is a US National Stage of International Application No. PCT/GB2005/000961, filed 14 Mar. 2005, which claims the benefit of GB 0405715.4, filed 13 Mar. 2004.

FIELD OF THE INVENTION

This invention relates to containers and in particular to containers for storing and transporting granular products. Such products may include, for instance, plastic pellets, grain, sugar and soap powders.

BACKGROUND TO THE INVENTION

Typically, granular products are discharged from storage and transportation containers as a result of gravity flow of the product towards an outlet positioned at the bottom of the container.

Granular products have been transported by road vehicle for perhaps 30 years. For most of this time the generally cylindrical shaped container formed part of the road vehicle. About five years ago containers have been introduced which are separate from the vehicle. The container, again of generally the cylindrical shape, is mounted in an ISO frame and the entire assembly is carried by the vehicle.

The bottom section of such known containers might be shaped to facilitate the discharge of the granular product. However, this has the disadvantages that the container, having a relatively complex shape, is expensive to manufacture and, since gas pressure is normally applied to the interior of the container to assist discharge of the product, the container, being of complex shape, will progressively suffer from fatigue.

STATEMENTS OF THE INVENTION

According to the present invention there is provided a container for the transport or storage of a bulk granular product, said container being of generally cylindrical shape, there being located within the container a substantially conical exit hopper, the container being further provided with means to convey the granular product from the exit hopper to the exterior of the container.

Preferably the conveying means is in the form of a conduit extending upwardly from the vicinity of the apex of the cone to a container outlet located above the bottom of the container. By feeding the granular product upwardly from the apex of the cone and out of the container via an outlet raised above the bottom of the container, there is no requirement for space beneath the container to accommodate pipework. Accordingly, the whole of the available space can be occupied by the container itself. A relatively high proportion of the overall space can be used for accommodating the granular product.

The simple cylindrical shape of a container in accordance with the present invention implies a relatively low cost system compared with known systems, including containers of relatively complex shapes. Furthermore such a simple shaped vessel is not subject to fatigue caused by repeated applications of gas pressure within the container.

A container in accordance with the present invention may be mounted directly on vehicles such as road and rail tankers or may be located in, for instance, an ISO frame. In the latter case the entire frame, including the container, is loaded on and off a vehicle during transportation.

Preferably the interior of the container is provided with a plurality of conical exit hoppers arranged in side by side relationship extending along the length of the container. In a typical case, three such exit hoppers may be provided within the container.

The exit hoppers are preferably interconnected both to each other and to the interior of the walls of the container so as to provide continuous connection between the upper open ends of the hoppers and the wall of the container. Thus, the space within the container for accommodating the granular product is defined by the inner surfaces of the hoppers and the inner surfaces of the container walls located above the hoppers.

Preferably the hopper or hoppers form an assembly which is readily locatable and fixable within the container and is also easily removed. As a result this assembly may be replaced by another one if the original needs replacing. Furthermore the original assembly may be replaced by a new one where a different cone angle is required, for instance, to handle a different product. This is facilitated by the provision of an internal cone structure which itself is not pressure retaining.

In another aspect, the present invention provides an internal cone assembly, including at least one conical exit hopper, for location within a generally cylindrical storage or transportation container.

The conical assembly may be made of any suitable material, examples being mild steel and stainless steel. It is formed so as to provide a continuous reception surface with no joints. The cone assembly is not only easy to make but can be used in the storage and transport of foodstuffs and pharmaceutical products since it is inherently a device which can be maintained in a hygienic condition. The internal surfaces can, for instance, be polished both for smooth movement of the granular product and also to maintain the device in a hygienic condition.

A container of the present invention may, in addition to use for the transport and delivery of a granular product, be then used, on its return journey, for the transport of a liquid or semi-liquid product. Whether with or without the cone assembly being removed, a removable liner or bladder may be fitted for such a return journey. As a result the container may be used for the transportation and delivery of various products including, by way of example, wine concentrate and tomato puree.

DETAILED DESCRIPTION OF THE INVENTION

Figure 1:
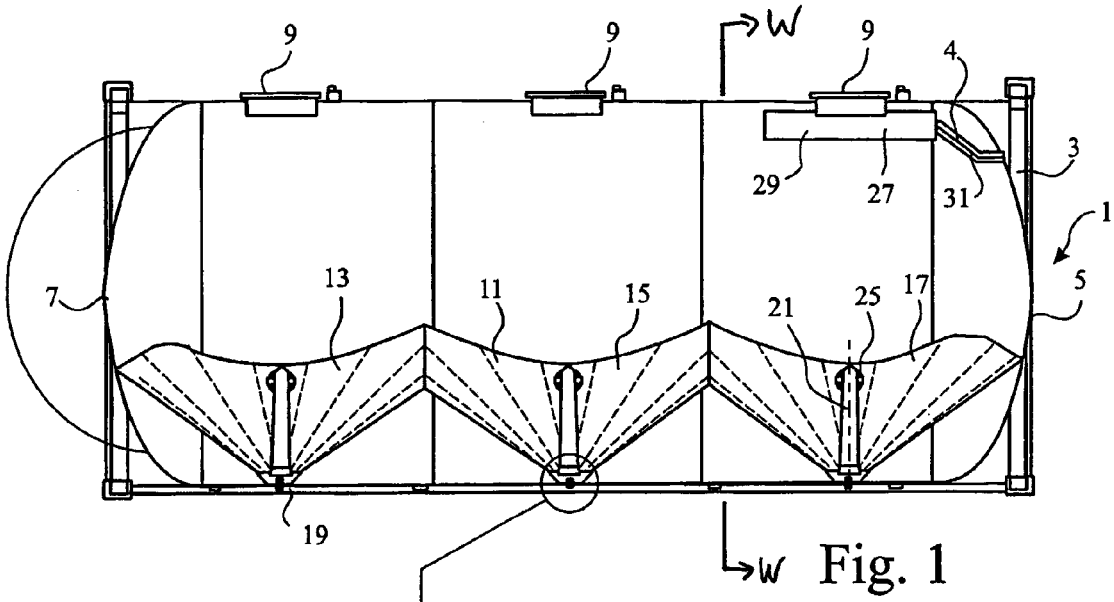
FIG. 1 is a longitudinal section of a container in accordance with the present invention.

The invention will now be described, by way of example only, with reference to the accompanying drawings.

Referring to the accompanying drawings, a container 1 is mounted within an ISO frame 3 and is of generally cylindrical shape with rounded or domed ends 5 and 7. Container 1 is capable of withstanding substantial internal pressure and is provided with upper inlets 9 by which bulk granular material may be loaded into the container.

Mounted within container 1 is a cone assembly 11 comprising three connected together coned exit hoppers 13, 15 and 17. Each exit hopper 13, 15, 17 has a flattened closed apex 19 which is bolted to the bottom of container 1 as indicated in detail in FIG. 2.

At the upper edges the exit hoppers 13, 15 and 17 are contoured so as to follow and fit snugly against the internal surface of container 1. Where two exit hoppers are connected together, the upper edges have been contoured appropriately. The assembly can be imagined as having been formed from three overlapping exit hoppers, originally of circular cross-section but with upper abutting portions removed to enable them to be connected together as shown in FIG. 1.

With the cone assembly 11 fitted within container 1 there is defined an internal space, bounded by the internal wall of container 1 and the inner surfaces of the cone assembly 11 into which bulk granular material may be loaded via inlets 9.

Figure 2:
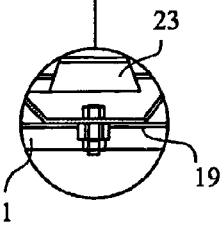
FIG. 2 shows detail of the lower part of an exit hopper of the container of FIG. 1.
Figure 3:
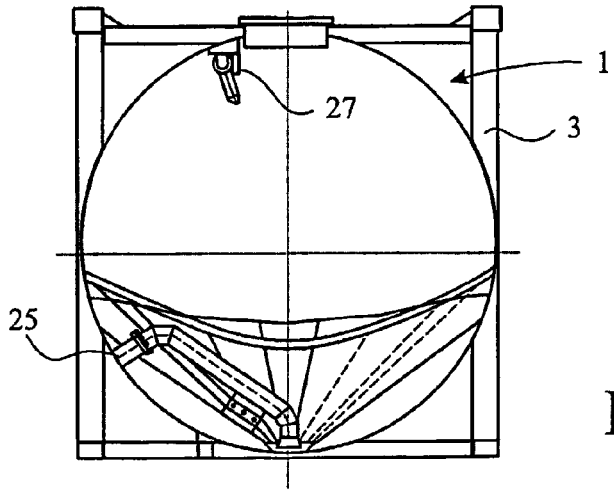
FIG. 3 is a transverse section (on line W-W of FIG. 1) of the container of FIG. 1.

Each conical exit hopper 13, 15, 17 is provided with an outlet pipe 21 which extends from a position within the exit hopper to the wall of the container 1 at a position outside the outer surface of the exit hopper. Within the exit hopper pipe 21 terminates just above the apex 19 of the hopper, the pipe 21 having an outwardly flared end 23 as best seen in FIG. 2. Pipe 21 extends upwardly from flared end 23, bending first in a direction towards the wall of the hopper and then extending adjacent said wall, with a slight inclination towards the wall, until it reaches a position quite near the upper edge of the hopper. At this position pipe 21 bends again so that it then continues through the wall of the hopper, follows a further short straight section, terminating at a position 25 at the wall of the container. At this position 25 a pipe connector can be attached prior to discharge of the contents of the container via the pipes 21, as will be further described below.

Also located within container 1 is a filter arrangement 27. Arrangement 27 includes a filter element 29, supported from the roof of the container, and in fluid connection with a pipe 31 extending from element 29 to the domed end wall 5 of container 1. During discharging of the container 1, a pipe connection may be made to the pipe 31 to enable air to be pumped into the container and cleaned by filter element 29.

Figure 4:
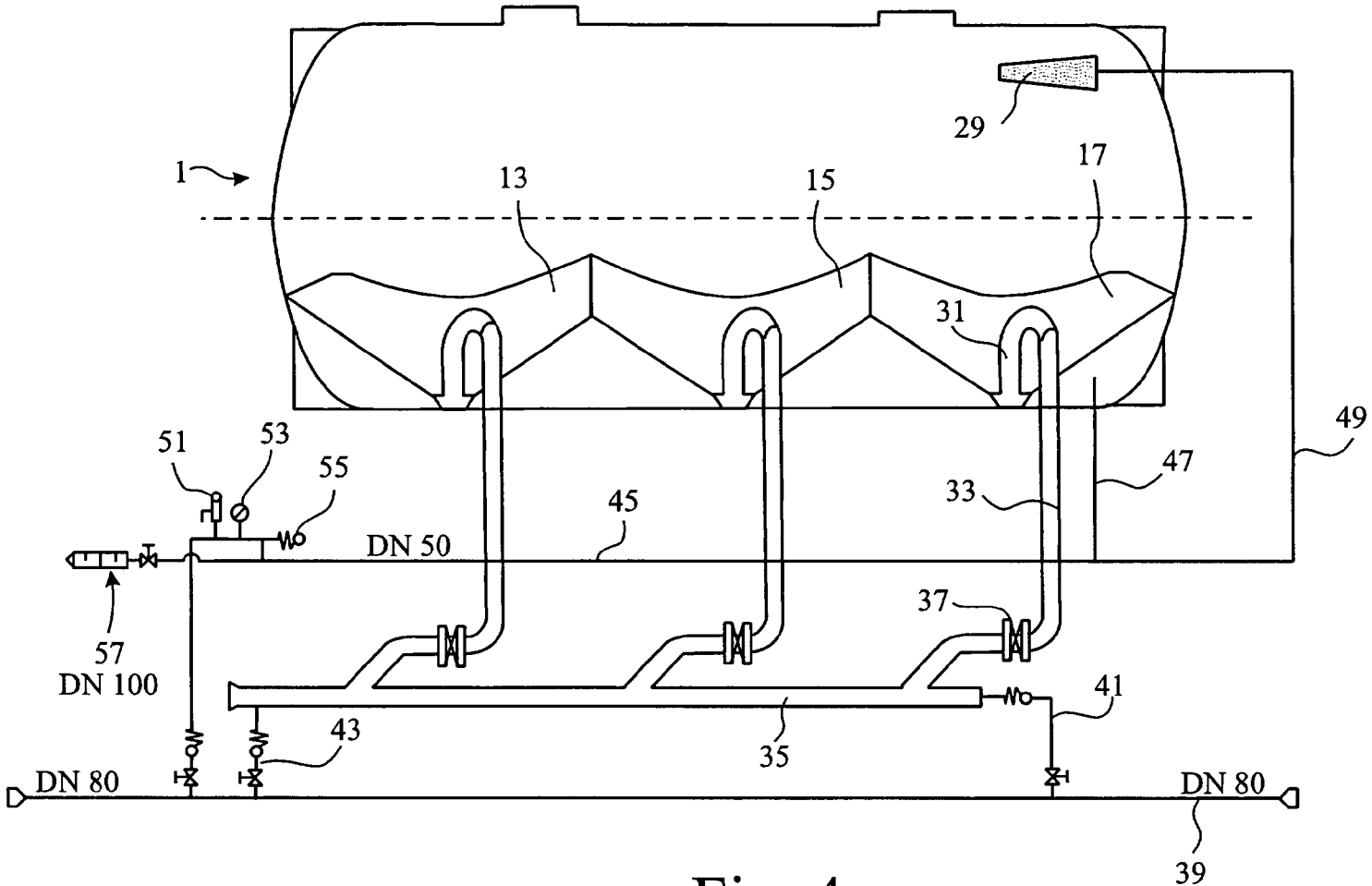
FIG. 4 is a schematic diagram showing the container of FIG. 1 and its associated pipework for discharging of granular products.

Referring particularly to FIG. 4 of the accompanying drawings, there is illustrated the pipework associated with the discharging of bulk granular material from container 1. This pipework includes that attached to the internal pipes 21 through which the bulk granular material will flow. Each pipe 21 is connected to a corresponding length of pipe 33 which leads away from container 1 to a common horizontal discharge line 35. Each pipe 33 is fitted with a manually actuated butterfly valve 37.

The further pipework illustrated in FIG. 4 is for the conveying of air under pressure both to the container 1 and to the discharge line 35. Compressed air from a pump or blower (not shown) is fed into line 39 and thence into container 1 both above and below the exit hoppers 13, 15, 17. As a result the pressure within container 1, both above and below the hoppers, is balanced so that no load is exerted on the hoppers except that of the weight of the granular material. The latter load is low compared with the applied gas pressure load.

The pressure is also fed via line 41 to the end of discharge line 35 to assist in the conveying of bulk material along line 35 and away from the container to its destination. An airline 43 extends from airline 39 to discharge line 35 to assist in feeding bulk material where necessary. Airline 45, which extends from line 39 to the container, entry to the latter being via lines 47 to below the hoppers and line 49 to an upper part of the container and the internal filter 29. This line 45 is fitted with pressure relief valve 51, pressure gauge 53 and a vacuum relief valve 55. In addition there is also fitted to this line an air dump line 57 including a filter and silencer.

Figure 5:
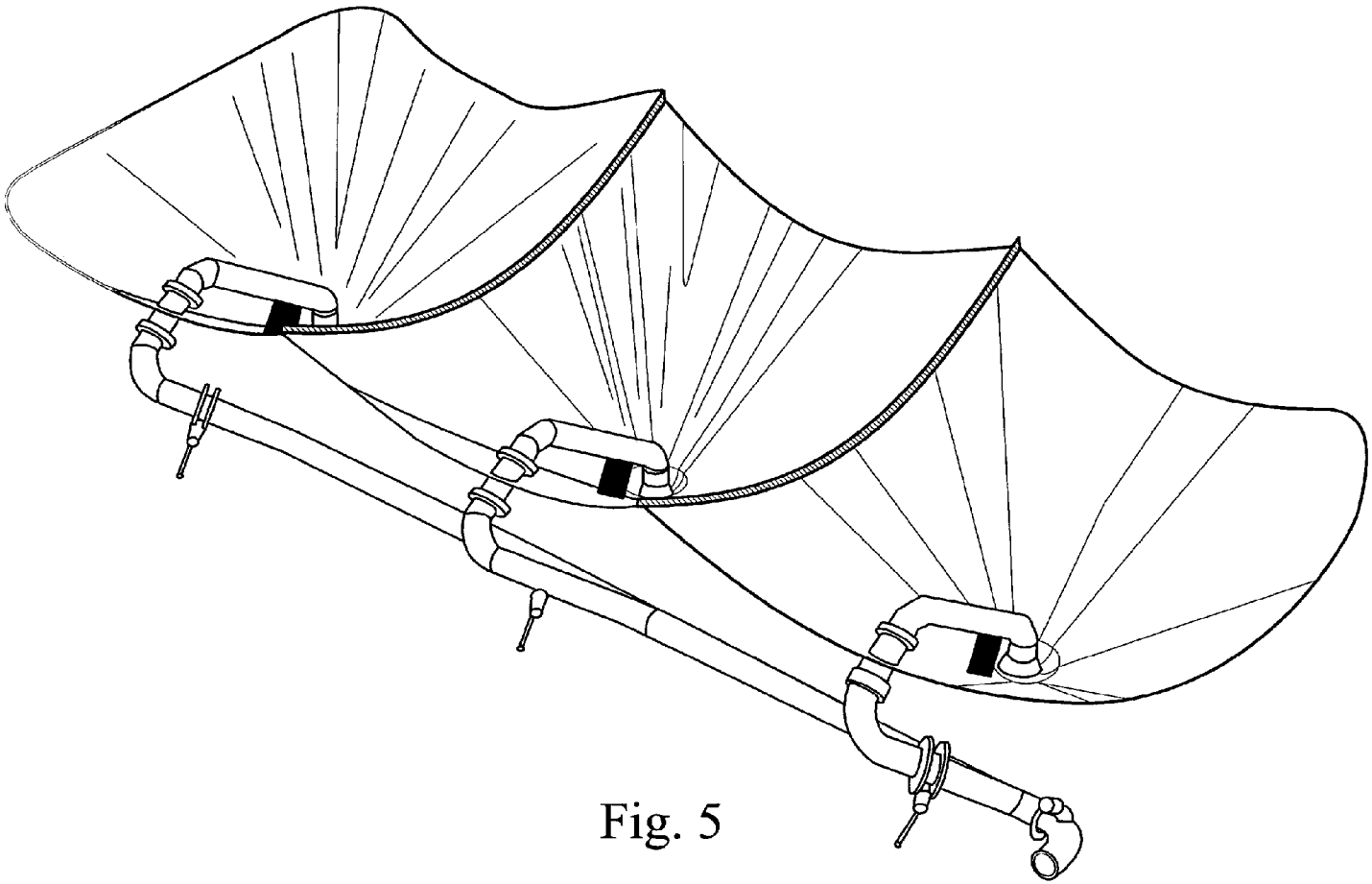
FIG. 5 is a perspective underneath view of a cone assembly for use with the container of FIG. 1.

Finally, referring to FIG. 5 there is shown an underneath perspective view of the cone assembly 11 together with the pipework used for the discharge of the bulk material. It can be seen that the cone assembly is a single structure having three connected together hoppers and contoured upper edges to fit within the container 1.

The invention claimed is:

1. A container for the transport or storage of a bulk granular product, said container defined by a wall of generally cylindrical shape, the container comprising:

a substantially conical exit hopper located wholly within the container;

a conveying means to convey the granular product from the exit hopper to the exterior of the container; and a pressurizing means to convey pressure during discharge of the granular product, whereby the pressurizing means conveys pressure to the top of the container through a filter and also conveys pressure below the exit hopper such that the pressure within the container is balanced during discharge.

2. A container according to claim 1 wherein the conveying means comprises a conduit extending upwardly from the vicinity of an apex of a cone of the container to a container outlet located above the bottom of the container.

3. A container according to claim 1 wherein the interior of the container is provided with a plurality of conical exit hoppers arranged in side-by-side relationship extending along the length of the container.

4. A container according to claim 3 wherein three exit hoppers are provided within the container.

5. A container according to claim 3 wherein the exit hoppers comprise upper open ends and are interconnected both to each other and to the interior of the wall of the container so as to provide continuous connection between the upper open ends of the hoppers and the wall of the container.

6. A container according to claim 1 wherein the hopper forms an assembly which is readily locatable and fixable within the container and is also easily removed therefrom.

7. A container according to claim 6 wherein the assembly is made of mild steel or stainless steel.

8. A tanker having mounted thereon the container of claim 1.

9. A container according to claim 1 wherein the container is located in an ISO frame.

10. A container according to claim 1 wherein the pressurizing means conveys a pressurized fluid.

11. A container according to claim 1 wherein the pressurizing means conveys a pressurized gas.

* * * * *